US005112482A

United States Patent [19]

Shaub et al.

[11] Patent Number: 5,112,482

[45] Date of Patent: May 12, 1992

[54] FILTER FOR REMOVING HYDROPEROXIDES FROM LUBRICATING OILS

[75] Inventors: Harold Shaub, Berkeley Heights; Darrell W. Brownawell, Scotch Plains; Arthur DiBenedetto, Rahway, all of N.J.

[73] Assignee: Exxon Research and Engineering Company, Florham Park, N.J.

[21] Appl. No.: 619,570

[22] Filed: Nov. 29, 1990

Related U.S. Application Data

[62] Division of Ser. No. 404,250, Sep. 7, 1989, Pat. No. 4,997,546.

[51] Int. Cl.[5] ..... B01D 27/00

[52] U.S. Cl. ..... 210/209; 210/416.5; 210/501; 210/502.1; 210/506

[58] Field of Search ..... 210/777, 193, 209, 416.5, 210/501, 502.1, 504, 506, 909, 168

[56] References Cited

U.S. PATENT DOCUMENTS

| | | | |
|---|---|---|---|
| 4,144,166 | 3/1979 | DeJovine | 208/180 |
| 4,906,389 | 3/1990 | Brownawell et al. | 252/25 |
| 4,943,352 | 7/1990 | Lefebvre et al. | 210/436 |
| 4,977,871 | 12/1990 | Brownawell et al. | 208/182 |

*Primary Examiner*—Peter Hruskoci
*Attorney, Agent, or Firm*—John W. Ditsler

[57] ABSTRACT

Hydroperoxides can be removed from a lubricating oil by contacting the oil passing through an oil filter with a heterogenous hydroperoxide decomposer. This extends the useful life of the oil and the equipment being lubricated. In a preferred embodiment, the hydroperoxide decomposer is incorporated on a substrate immobilized within the lubrication system of an internal combustion engine.

6 Claims, No Drawings

FILTER FOR REMOVING HYDROPEROXIDES FROM LUBRICATING OILS

This is a division of application Ser. No. 404.250 filed Sep. 7, 1989 now U.S. Pat. No. 4,997,546.

BACKGROUND OF THE INVENTION

1. Field of the Invention

This invention concerns removing hydroperoxides from a lubricating oil by contacting the oil with a heterogenous hydroperoxide decomposer.

2. Description of Related Art

Hydroperoxides are known to be a source of free radicals which cause oxidative degradation of hydrocarbon oils (see M. D. Johnson et al. SAE Paper No. 831684. Nov. 1983). Hydroperoxides have also been shown to promote valve train wear in automotive engines (see SAE Paper Nos. 872156 and 872157 as well as J. J. Habeeb et al. "The Role of Hydroperoxides in Engine Wear and the Effect of Zinc Dialkyldithiophosphates", *ASLE Transactions*, Vol. 30, 4, p. 419-426). Furthermore, zinc dialkyldithiophosphate (ZDDP), which has been used as an antiwear agent in lubricating oils for several years, has also been found to decompose hydroperoxides (see ASLE Transactions, supra.). However, the ZDDP in the oil will become depleted such that the oil must be periodically replaced.

As such, in view of the deleterious effects resulting from the presence of hydroperoxides in lubricating oil, it would be desirable to have available a simple, yet convenient, method of decomposing hydroperoxides while extending the useful life of the oil before it must be replaced.

SUMMARY OF THE INVENTION

This invention concerns a filter for removing hydroperoxides from a lubricating oil. More specifically, we have discovered that hydroperoxides can be effectively removed from used lubricating oil by contacting the oil with a heterogenous hydroperoxide decomposer. By "heterogenous" is meant that the hydroperoxide decomposer is in a separate phase (or substantially in a separate phase) from the lubricating oil; i.e. the hydroperoxide decomposer is insoluble or substantially insoluble in the oil. The hydroperoxide decomposer should be immobilized in some manner when contacting the oil (e.g. in crystalline form or incorporated on a substrate) to avoid solids passing into the oil. In a preferred embodiment, hydroperoxides are removed from lubricating oil circulating within the lubrication system of an internal combustion engine by contacting the oil with a hydroperoxide decomposer that is incorporated on a substrate immobilized within the lubrication system. Most preferably, the hydroperoxide decomposer is immobilized on activated carbon in the oil filter of the engine. $MoS_2$, $Mo_4S_4(ROCS_2)_6$, NaOH, or mixtures thereof are preferred hydroperoxide decomposers, with $Mo_4S_4(ROCS_2)_6$ and NaOH being more preferred. R is an alkyl group having from 2 to 20 carbon atoms.

DETAILED DESCRIPTION OF THE INVENTION

In this invention, essentially any hydroperoxide decomposer can be used to remove hydroperoxides from a lubricating oil. Particularly effective hydroperoxide decomposers are $MoS_2$, $Mo_4S_4(ROCS_2)_6$, NaOH, or mixtures thereof. $Mo_4S_4(ROCS_2)_6$, NaOH, or mixtures thereof are more preferred, with NaOH being most preferred.

As disclosed in copending U.S. patent application Ser. No. 404,142, filed on the same date herewith, $Mo_4S_4(ROCS_2)_6$ is formed by reacting molybdenum hexacarbonyl, $Mo(CO)_6$, with a dixanthogen, $(ROCS_2)_2$. The reaction is conducted at temperatures ranging from about ambient conditions (e.g., room temperature) to about 140° C., especially between about 80° to about 120° C., for from about 2 to about 10 hours. For example, the $Mo(CO)_6$ and the dixanthogen may be refluxed in toluene for times ranging from about 2 to about 8 hours. The reaction time and temperature will depend upon the dixanthogen selected and the solvent used in the reaction. However, the reaction should be conducted for a period of time sufficient to form the compound. Solvents that are useful in the reaction include aromatic hydrocarbons, especially toluene.

Dixanthogens which are especially useful can be represented by the formula $(ROCS_2)_2$ in which R can be the same or different organo groups selected from alkyl, aralkyl, and alkoxyalkyl groups having a sufficient number of carbon atoms such that the compound formed is soluble in a lubricating oil. Preferably R will have from 2 to 20 carbon atoms. More preferably, R will be an alkyl group having from 2 to 20 carbon atoms, especially from 4 to 12 carbon atoms.

In forming $Mo_4S_4(ROCS_2)_6$, the mole ratio of dixanthogen to molybdenum hexacarbonyl should be greater than about 1.5 to 1.0. For example, in preparing this compound, mole ratios of $(ROCS_2)_2$ to $Mo(CO)_6$ in the range of from about 1.6:1 to about 2:1 are preferred.

Depending primarily upon the time and temperature at which the $Mo(CO)_6$ and $(ROCS_2)_2$ are reacted, the molybdenum and sulfur containing additive that forms is a brown compound, a purple compound, or a mixture of both. Shorter reaction times (e.g., four hours or less) favor the formation of the purple compound. Longer reaction times (e.g.; four hours or more) favor formation of the brown compound. For example, when $(C_8H_{17}OCS_2)_2$ is reacted with $Mo(CO)_6$ in toluene for four hours at 100° to 110° C., most of the starting material is converted to the purple compound, with virtually none of the brown compound being present. However, continued heating of the reaction mixture results in conversion of the purple compound to the brown compound. Indeed, after about six or seven hours, the purple form is largely converted to the brown form.

In general, the $Mo(CO)_6$ and dixanthogen are contacted for a period of time sufficient for reaction to occur, but typically less than about 7 hours. Beyond 7 hours, undesirable solids begin to form. To maximize the formation of the compound and minimize the formation of undesirably solid by-products, the $Mo(CO)_6$ should be reacted with the dixanthogen at temperatures of about 100° to about 120° C. for times ranging from about five to six hours, thereby producing reaction mixtures which contain both the brown and purple forms of the compounds. This is not a disadvantage because both forms are effective additives, and mixtures of the two species (brown and purple) perform as well as either species alone.

The compounds formed with R groups between about $C_4H_9$ and about $C_{14}H_{29}$ can be readily separated from oily organic by-products of the reaction by extracting the oily by-products with moderately polar solvents such as acetone, ethyl alcohol, or isopropyl alcohol. The compounds with these R groups are substantially insoluble in such solvents, while the oily by-products are soluble. Separation of the compounds from the by-products, however, is not necessary because the by-products do not detract from the beneficial functional properties of the compounds.

The physical properties of the purple and brown forms vary with the R group. For example, the compound is a crystalline solid when R is $C_2H_5$ and an amorphous solid when R is larger than about $C_7H_{15}$.

The purple compound formed in reacting $Mo(CO_6)$ with $(ROCS_2)_2$ is a thiocubane of the formula $Mo_4S_4(ROCS_2)_6$.

The brown compound formed in reacting $Mo(CO_6)$ with $(ROCS_2)_2$ is also believed to have a structure very similar to the thiocubane structure of the purple compound based on its ease of formation from the purple compound and chemical analysis.

While not wishing to be bound by an particular theory, the hydroperoxides in the oil are believed to contact the heterogenous hydroperoxide decomposer and be catalytically decomposed into harmless species that are soluble in the oil.

The precise amount of hydroperoxide decomposer used can vary broadly, depending upon the amount of hydroperoxide present in the lubricating oil. However, although only an amount effective (or sufficient) to reduce the hydroperoxide content of the lubricating oil need be used, the amount will typically range from about 0.05 to about 2.0 wt. %, although greater amounts could be used. Preferably, from about 0.01 to about 1.0 wt. % (based on weight of the lubricating oil) of the hydroperoxide decomposer will be used.

The heterogenous hydroperoxide decomposers should be immobilized in some manner when contacting the oil. For example, they could be immobilized on a substrate. However, a substrate would not be required if the hydroperoxide decomposer used were the crystalline form of $Mo_4S_4(ROCS_2)_6$ wherein $R=C_2H_5$. If a substrate were used, the substrate may (or may not) be within the lubrication system of an engine. Preferably, the substrate will be located within the lubrication system (e.g., on the engine block or near the sump). More preferably, the substrate will be part of the filter system for filtering the engine's lubricating oil, although it could be separate therefrom. Suitable substrates include, but are not limited to, alumina, activated clay, cellulose, cement binder, silica-alumina, and activated carbon. Alumina, cement binder, and activated carbon are preferred substrates, with activated carbon being particularly preferred. The substrate may (but need not) be inert and can be formed into various shapes such as pellets or spheres.

The hydroperoxide decomposer may be incorporated on or with the substrate by methods known to those skilled in the art. For example, if the substrate were activated carbon, the hydroperoxide decomposer can be deposited by using the following technique. The hydroperoxide decomposer is dissolved in a volatile solvent. The carbon is then saturated with the hydroperoxide decomposer-containing solution and the solvent evaporated, leaving the hydroperoxide decomposer on the carbon substrate.

Hydroperoxides are produced when hydrocarbons in the lubricating oil contact the peroxides formed during the fuel combustion process. As such, hydroperoxides will be present in essentially any lubricating oil used in the lubrication system of essentially any internal combustion engine, including automobile and truck engines, two-cycle engines, aviation piston engines, marine and railroad engines, gas-fired engines, alcohol (e.g. methanol) powered engines, stationary powered engines, turbines, and the like. In addition to hydroperoxides, the lubricating oil will comprise a major amount of lubricating oil basestock (or lubricating base oil) and a minor amount of one or more additives. The lubricating oil basestock can be derived from a wide variety of natural lubricating oils, synthetic lubricating oils, or mixtures thereof. In general, the lubricating oil basestock will have a viscosity in the range of about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and poly-carboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like. Synthetic hydrocarbon oils are also obtained from hydrogenated oligomers of normal olefins.

Silicon-based oils (such as the polyakyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The lubricating base oil may also contain one or more additives so as to form a fully formulated lubricating oil. Such lubricating oil additives include dispersants, antiwear agents, antioxidants, corrosion inhibitors, detergents, pour point depressants, extreme pressure additives, viscosity index improvers, friction modifiers, and the like. These additives are typically disclosed, for example, in "Lubricant Additives" by C. V. Smalheer and R. Kennedy Smith, 1967, pp. 1-11 and in U.S. Pat. No. 4,105,571, the disclosures of which are incorporated herein by reference. Normally, there is from about 1 to about 20 wt. % of these additives in a fully formulated lubricating oil. However, the precise additives used (and their relative amounts) will depend upon the particular application of the oil.

This invention can also be combined with the removal of carcinogenic components from a lubricating oil, as is disclosed in European Patent Application 88300090.3 (published Jul. 20, 1988 having Publication No. 0275148), the disclosure of which is incorporated herein by reference. For example, polynuclear aromatic hydrocarbons (especially PNA's with at least three aromatic rings) that are usually present in used lubricating oil can be substantially removed (i.e., reduced by from about 60 to about 90% or more) by passing the oil through a sorbent. The sorbent may be immobilized with the substrate (or a crystalline form of the hydroperoxide decomposer) described above. Preferably, the substrate and sorbent will be located within the lubrication system of an internal combustion engine through which the oil must circulate after being used to lubricate the engine. Most preferably, the substrate and sorbent will be part of the engine filter system for filtering oil. If the latter, the sorbent can be conveniently located on the engine block or near the sump, preferably downstream of the oil as it circulates through the engine (i.e., after the oil has been heated). Most preferably, the sorbent is downstream of the substrate or crystalline material.

Suitable sorbents include activated carbon, attapulgus clay, silica gel, molecular sieves, dolomite clay, alumina, zeolite, or mixtures thereof. Activated carbon is preferred because (1) it is at least partially selective to the removal of polynuclear aromatics containing more than 3 aromatic rings, (2) the PNA's removed are tightly bound to the carbon and will not be leached-out to become free PNA's after disposal, (3) the PNA's removed will not be redissolved in the used lubricating oil, and (4) heavy metals such as lead and chromium will be removed as well. Although most activated carbons will remove PNA's to some extent, wood and peat based carbons are significantly more effective in removing four and higher ring aromatics than coal or coconut based carbons.

The amount of sorbent required will depend upon the PNA concentration in the lubricating oil. Typically, for five quarts of oil, about 20 to about 150 grams of activated carbon can reduce the PNA content of the use lubricating oil by up to 90%. Used lubricating oils usually contain from about 10 to about 10,000 ppm of PNA's.

It may be necessary to provide a container to hold the sorbent, such as a circular mass of sorbent supported on wire gauze. Alternatively, an oil filter could comprise the sorbent capable of combining with polynuclear aromatic hydrocarbons held in pockets of filter paper. These features would also be applicable to the substrate described above.

Any of the foregoing embodiments of this invention can also be combined with a sorbent (such as those described above) that is mixed, coated, or impregnated with additives normally present in lubricating oils, particularly engine lubricating oils (see European Patent Application 0 275 148). In this embodiment, additives (such as the lubricating oil additives described above) are slowly released into the lubricating oil to replenish the additives as they are depleted during operation of the engine. The ease with which the additives are released into the oil depends upon the nature of the additive and the sorbent. Preferably, however, the additives will be totally released within 150 hours of engine operation. In addition, the sorbent may contain from about 50 to about 100 wt. % of the additive (based on the weight of activated carbon), which generally corresponds to 0.5 to 1.0 wt. % of the additive in the lubricating oil.

Any of the foregoing embodiments may also be combined with a method for reducing piston deposits resulting from neutralizing fuel combustion acids in the piston ring zone (i.e., that area of the piston liner traversed by the reciprocating piston) of an internal combustion engine (such as is disclosed in copending U.S. application Ser. No. 269,274, filed Nov. 9, 1988, now U.S. Pat. No. 4,906,389). More specifically, these deposits can be reduced or eliminated from the engine by contacting the combustion acids at the piston ring zone with a soluble weak base for a period of time sufficient to neutralize a major portion (preferably essentially all) of the combustion acids and form soluble neutral salts which contain a weak base and a strong combustion acid.

This embodiment requires that a weak base be present in the lubricating oil. The weak base will normally be added to the lubricating oil during its formulation or manufacture. Broadly speaking, the weak bases can be basic organophosphorus compounds, basic organonitrogen compounds, or mixtures thereof, with basic organonitrogen compounds being preferred. Families of basic organophosphorus and organonitrogen compounds include aromatic compounds, aliphatic compounds, cycloaliphatic compounds, or mixtures thereof. Examples of basic organonitrogen compounds include, but are not limited to, pyridines; anilines; piperazines; morpholines; alkyl, dialkyl, and trialky amines; alkyl polyamines; and alkyl and aryl guanidines. Alkyl, dialkyl, and trialkyl phosphines are examples of basic organophosphorus compounds.

Examples of particularly effective weak bases are the dialkyl amines ($R_2HN$), trialkyl amines ($R_3N$), dialkyl phosphines ($R_2HP$), and trialkyl phosphines ($R_3P$), where R is an alkyl group, H is hydrogen, N is nitrogen, and P is phosphorus. All of the alkyl groups in the amine or phosphine need not have the same chain length. The alkyl group should be substantially saturated and from 1 to 22 carbons in length. For the di- and tri- alkyl phosphines and the di- and tri-alkyl amines, the total number of carbon atoms in the alkyl groups should be from 12 to 66. Preferably, the individual alkyl group will be from 6 to 18, more preferably from 10 to 18, carbon atoms in length.

Trialkyl amines and trialkyl phosphines are preferred over the dialkyl amines and dialkyl phosphines. Examples of suitable dialkyl and trialkyl amines (or phosphines) include tributyl amine (or phosphine), dihexyl amine (or phosphine), decylethyl amine (or phosphine), trihexyl amine (or phosphine), trioctyl amine (or phosphine), trioctyldecyl amine (or phosphine), tridecyl amine (or phosphine), dioctyl amine (or phosphine), trieicosyl amine (or phosphine), tridocosyl amine (or phosphine), or mixtures thereof. Preferred trialkyl amines are trihexyl amine, trioctadecyl amine, or mixtures thereof, with trioctadecyl amine being particularly preferred. Preferred trialkyl phosphines are trihexyl phosphine, trioctyldecyl phosphine, or mixtures thereof, with trioctadecyl phosphine being particularly preferred. Still another example of a suitable weak base is the polyethyleneamine imide of polybutenylsuccinie anhydride with more than 40 carbons in the polybutenyl group.

The weak base must be strong enough to neutralize the combustion acids (i.e., form a salt). Suitable weak bases will typically have a PKa from about 4 to about 12. However, even strong organic bases (such as organoguanidines) can be utilized as the weak base if the strong base is an appropriate oxide or hydroxide and is capable of releasing the weak base from the weak base/-combustion acid salt.

The molecular weight of the weak base should be such that the protonated nitrogen compound retains its oil solubility. Thus, the weak base should have sufficient solubility so that the salt formed remains soluble in the oil and does not precipitate. Adding alkyl groups to the weak base is the preferred method to ensure its solubility.

The amount of weak base in the lubricating oil for contact at the piston ring zone will vary depending upon the amount of combustion acids present, the degree of neutralization desired, and the specific applications of the oil. In general, the amount need only be that which is effective or sufficient to neutralize at least a portion of the combustion acids present at the piston ring zone. Typically, the amount will range from about 0.01 to about 3 wt. % or more, preferably from about 0.1 to about 1.0 wt. %.

Following neutralization of the combustion acids, the neutral salts are passed or circulated from the piston ring zone with the lubricating oil and contacted with a heterogenous strong base. By strong base is meant a base that will displace the weak base from the neutral salts and return the weak base to the oil for recirculation to the piston ring zone where the weak base is reused to neutralize combustion acids. Examples of suitable strong bases include, but are not limited to, barium oxide (BaO), calcium carbonate ($CaCO_3$), calcium oxide (CaO), calcium hydroxide ($Ca(OH)_2$) magnesium carbonate ($MgCO_3$), magnesium hydroxide ($Mg(OH)_2$), magnesium oxide (MgO), sodium aluminate ($NaAlO_2$), sodium carbonate ($Na_2CO_3$), sodium hydroxide (NaOH), zinc oxide (ZnO), or their mixtures, with ZnO being particularly preferred. By "heterogenous strong base" is meant that the strong base is in a separate phase (or substantially in a separate phase) from the lubricating oil, i.e., the strong base is insoluble or substantially insoluble in the oil.

The strong base may be incorporated (e.g. impregnated) on or with a substrate immobilized in the lubricating system of the engine, but subsequent to (or downstream of) the piston ring zone. Thus, the substrate can be located on the engine block or near the sump. Preferably, the substrate will be part of the filter system for filtering oil, although it could be separate therefrom. Suitable substrates include, but are not limited to, alumina, activated clay, cellulose, cement binder, silica-alumina, and activated carbon. The alumina, cement binder, and activated carbon are preferred, with cement binder being particularly preferred. The substrate may (but need not) be inert.

The amount of strong base required will vary with the amount of weak base in the oil and the amount of combustion acids formed during engine operation. However, since the strong base is not being continuously regenerated for reuse as is the weak base (i.e., the alkyl amine), the amount of strong base must be at least equal to (and preferably be a multiple of) the equivalent weight of the weak base in the oil. Therefore, the amount of strong base should be from 1 to about 15 times, preferably from 1 to about 5 times, the equivalent weight of the weak base in the oil.

Once the weak base has been displaced from the soluble neutral salts, the strong base/strong combustion acid salts thus formed will be immobilized as heterogenous deposits with the strong base or with the strong base on a substrate if one is used. Thus, deposits which would normally be formed in the piston ring zone are not formed until the soluble salts contact the strong base. Preferably, the strong base will be located such that it can be easily removed from the lubrication system (e.g., included as part of the oil filter system).

Thus, this invention can be combined with removing PNA's from a lubricating oil, enhancing the performance of a lubricating oil by releasing conventional additives into the oil, reducing piston deposits in an internal combustion engine, or a combination thereof.

Although this invention has heretofore been described with specific reference to removing hydroperoxides from lubricating oils used in internal combustion engines, it can also be suitably applied to essentially any oil (e.g. industrial lubricating oils) containing hydroperoxides.

This invention may be further understood by reference to the following examples which are not intended to restrict the scope of the appended claims. In these examples, the oxidative stability of the oils tested was determined by two methods—measuring the Differential Scanning Calorimetry (DSC) Break Temperature and calculating the Hydroperoxide Number (HPN).

DSC Break Temperature

A test sample of known weight is placed in a DSC 30 Cell (Mettler TA 3000) and continuously heated with an inert reference at a programmed rate under an oxidizing air environment. If the test sample undergoes an exothermic or endothermic reaction or a phase change, the event and magnitude of the heat effects relative to the inert reference are monitored and recorded. More specifically, the temperature at which an exothermic reaction begins due to oxidation by atmospheric oxygen is considered as a measure of the oxidation stability of the test sample. The higher the DSC Break Temperature, the more oxidatively stable the test sample. All DSC evaluations were performed using the DSC 30 cell at atmospheric pressure and scanning temperatures from 50° to 300° C. (at least 25° C. above the start of the temperature scan) to avoid incorporating the initial heat flow between reference and sample into the baseline measurement. The oxidation onset temperature (or DSC Break Temperature) is the temperature at which the baseline (on the exothermal heat flow versus temperature plot) intersects with a line tangent to the curve at a point one heat energy threshold above the baseline. At times it is necessary to visually examine the plot to identify the true heat energy threshold for the start of oxidation.

Hydroperoxide Number

The Hydroperoxide Number of an oil sample was determined using the following steps:

1. Add 2 grams of the sample to a 250 ml volumetric flask containing a 3:2 acetic acid:chloroform mixture.
2. Add 2 ml of a saturated aqueous potassium iodide solution (see below for preparation) to the mixture in step 1.
3. Flush the flask containing the mixture from step 2 with $N_2$ gas, cap the flask, and then let it stand at room temperature for about 15 minutes.
4. Add 50 ml of distilled water and 4 drops of starch indicator solution (see below for preparation). The resulting mixture has a blue color.
5. Titrate the mixture in step 4 with 0.1N sodium thiosulfate ($Na_2S_2O_3$) solution until the mixture becomes colorless.
6. Repeat steps 1-5 without the 2 grams of sample to determine the volume of 0.1N $Na_2S_2O_3$ for a blank.
7. Calculate the Hydroperoxide Number as follows:

$$HPN = \frac{\text{mmoles ROOH}}{\text{Kg sample}} = \frac{[A - B].N}{2W} \times 1000$$

where:

A = Volume of 0.1N $Na_2S_2O_3$ to titrate 2 gram sample (procedure, step 5).

B = Volume of 0.1N $Na_2S_2O_3$ for blank determination (procedure, step 6).

N = Normality of $Na_2S_2O_3$

W = Weight of the sample in kilograms.

The starch indicator solution is prepared as follows:

a. Make a paste of 4 grams of starch and 50 grams of distilled and de-ionized water.
b. Add this paste, with stirring, to 500 mls of boiling distilled and de-ionized water.
c. Heat, with stirring, for approximately 15 minutes.
d. Add 2 grams of boric acid as a preservative.

The saturated aqueous potassium iodide solution is prepared as follows:

a. Add 1 gram potassium iodide to 1.3 ml $H_2O$.
b. A 100 ml solution is made by adding 77 grams of potassium iodide to a 100 ml volumetric flask, with distilled water then being added to reach 100 ml volume. Lower HPN's represent greater oxidative stability.

EXAMPLE 1

Four tests were performed in a laboratory apparatus to demonstrate the effectiveness of $Mo_4S_4(ROCS_2)_6$ impregnated on Norit RO 0.8 carbon (an activated carbon) in decomposing hydroperoxides present in a commercially available 10W-30 SF/CC grade engine motor oil. The apparatus contained a 250 ml flask and a filter. In each test, the oil sample was charged to the flask, pumped through the filter, and then returned to the flask to simulate oil flow in an engine.

In Test 1, a sample of the oil was tested.

In Test 2, a 200 ml sample of the oil was circulated through the apparatus for 6 hours while 2 ml/hr of t-butyl hydroperoxide (70% in water) was continuously added to the circulating oil. After 6 hours, the oil contained 12 ml t-BHP.

In Test 3, 6 g Norit carbon was present in the apparatus and the same t-butyl hydroperoxide used in Test 2 was added to the circulating oil at 2 ml/hr for 6 hours.

In Test 4, 1.5 g of $Mo_4S_4(C_8H_{17}OCS_2)_6$ was incorporated in 1.5 g Norit carbon and 6.0 ml of the t-butyl hydroperoxide used in Test 2 was added to 100 ml of the circulating oil at 2 ml/hr for 6 hours.

The oxidative stability for each sample tested was determined by measuring the DSC Break Temperature. The results of these tests are shown in Table 1 below in which HD represents the hydroperoxide decomposer $Mo_4S_4(C_8H_{17}OCS_2)_6$.

TABLE 1

| Test No. | Norit | Norit + HD | Oil + t-BHP | DSC Break Temp., °C. |
|---|---|---|---|---|
| 1 | N | N | N | 246 |
| 2 | N | N | Y | 215 |
| 3 | Y | N | Y | 219 |
| 4 | N | Y | Y | 246 |

The data in Table 1 show that the DSC Break Temperature (in which the higher temperature represents greater oxidative stability) of fresh oil (Test 1) is reduced to 215° C. and 219° C. in Tests 2 and 3. However, the DSC Break Temperature in Test 4 remained that of fresh oil under the same oxidative conditions as Tests 2 and 3. Thus, a hydroperoxide decomposer on a carbon substrate is effective in improving oxidative stability (i.e. reducing the hydroperoxide content) of a lubricating oil.

EXAMPLE 2

Another series of tests were performed to show the effectiveness of various compounds in improving the oxidative stability of a lubricating oil (as measured by the hydroperoxide concentration). Using the apparatus of Example 1, 2 ml/hr of t-BHP (70% in water) was added to several 200 ml samples of 10W-30 SF/CD grade engine motor oil over 6 hours. The total test time was 6 hours. The results of these tests are shown in Table 2 below in which HPN represents the hydroperoxide number measured in millimoles of hydroperoxide per kilogram of sample (the lower HPN representing greater oxidative stability).

TABLE 2

| Test No. | Material on Filter | t-BHP | DSC Break Temp., °C. | Used Oil HPN (mmoles HPO/ Kg sample) |
|---|---|---|---|---|
| 1 | — | — | 239 | 0.0 |
| 2 | — | Y | 218 | 23.5 |
| 3 | Norit Carbon | Y | 225 | 35.2 |
| 4 | ZnO | Y | 231 | 27.8 |
| 5 | Mo Phosphate/Carbon | Y | 229 | 10.8 |
| 6 | $MoS_2$/Carbon | Y | 233 | 6.8 |
| 7 | $Mo_4S_4(C_8H_{17}OCS_2)_6$/ Carbon | Y | 239 | 1.2 |
| 8 | NaOH/Carbon | Y | 242 | 0.5 |

The data in Table 2 show that $MoS_2$ on activated carbon, $Mo_4S_4$ $(C_8H_{17}OCS_2)_6$ on activated carbon, and NaOH on activated carbon are effective in improving the oxidative stability of a lubricating oil containing hydroperoxides. NaOH on activated carbon is particularly effective.

What is claimed is:

1. An oil filter suitable for removing hydroperoxides from a lubricating oil which comprises means for passing said lubricating oil through said filter, means for contacting said lubricating oil with a heterogenous hydroperoxide decomposer wherein the hydroperoxide decomposer is $Mo_4S_4(RCOS_2)_6$, and R is an alkyl group having from 2 to 20 carbon atoms.

2. The filter of claim 1 wherein the hydroperoxide decomposer comprises $Mo_4S_4(C_2H_5COS_2)_6$.

3. The filter of claim 1 wherein the hydroperoxide decomposer is immobilized on a substrate within the oil filter.

4. The filter of claim 3 wherein the substrate comprises activated carbon.

5. The filter of claim 3 wherein the substrate is alumina, activated clay, cellulose, cement binder, silica-alumina, activated carbon, or mixtures thereof.

6. The filter of claim 3 wherein the filter also contains a sorbent.

* * * * *